United States Patent [19]

Ivey

[11] Patent Number: 4,681,024

[45] Date of Patent: Jul. 21, 1987

[54] COMBINATION HEATER-LIGHT-VENTILATOR UNIT

[75] Inventor: Charles W. Ivey, Hope Mills, N.C.

[73] Assignee: Fasco Industries, Inc., Boca Raton, Fla.

[21] Appl. No.: 890,417

[22] Filed: Jul. 29, 1986

[51] Int. Cl.[4] ..... F24F 13/00

[52] U.S. Cl. ..... 98/34.6; 98/31.6; 98/42.07; 219/220; 219/361; 219/370; 219/473; 362/92; 362/149; 362/294

[58] Field of Search ..... 98/40.07, 40.08, 33.1, 98/34.6, 31.6, 42.07, 34.5; 362/147-149, 404, 408, 294, 373, 92; 219/220, 361, 369, 370, 472, 473

[56] References Cited

U.S. PATENT DOCUMENTS

| | | | |
|---|---|---|---|
| 2,870,319 | 1/1959 | Ford | 219/220 X |
| 2,875,316 | 2/1959 | Ford et al. | 219/361 |
| 3,001,056 | 9/1961 | Spear | 219/369 X |
| 3,028,475 | 4/1962 | Nash | 362/149 X |
| 3,068,341 | 12/1962 | Ortiz et al. | 219/220 |
| 3,309,502 | 3/1967 | Witherspoon, Jr. | 219/369 |
| 3,320,406 | 5/1967 | Wainwright | 219/220 X |
| 3,701,895 | 10/1972 | Sweetser | 98/40.08 X |
| 3,909,589 | 9/1975 | Stone et al. | 219/220 X |

*Primary Examiner*—Albert J. Makay
*Assistant Examiner*—Steven E. Warner
*Attorney, Agent, or Firm*—Shlesinger, Fitzsimmons & Shlesinger

[57] ABSTRACT

A combination heater-light-ventilator unit for mounting in a ceiling, is disclosed. A cylindrical housing supports the unit and an annular grille on its bottom includes an arcuate heat discharge outlet around part of its circumference and an arcuate air intake through the remainder, with a light diffuser supported in the center. The heat discharge outlet is configured to direct heat flow relatively straight down from the unit to minimize its recirculation through the arcuate air intake.

6 Claims, 3 Drawing Figures

FIG. 1
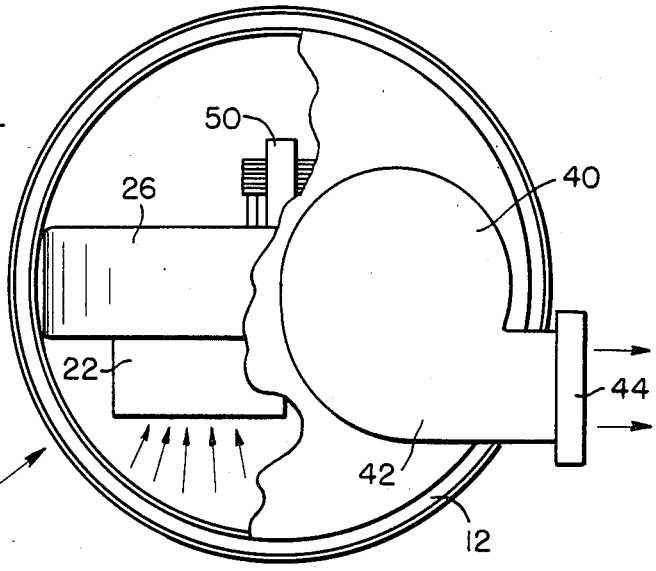
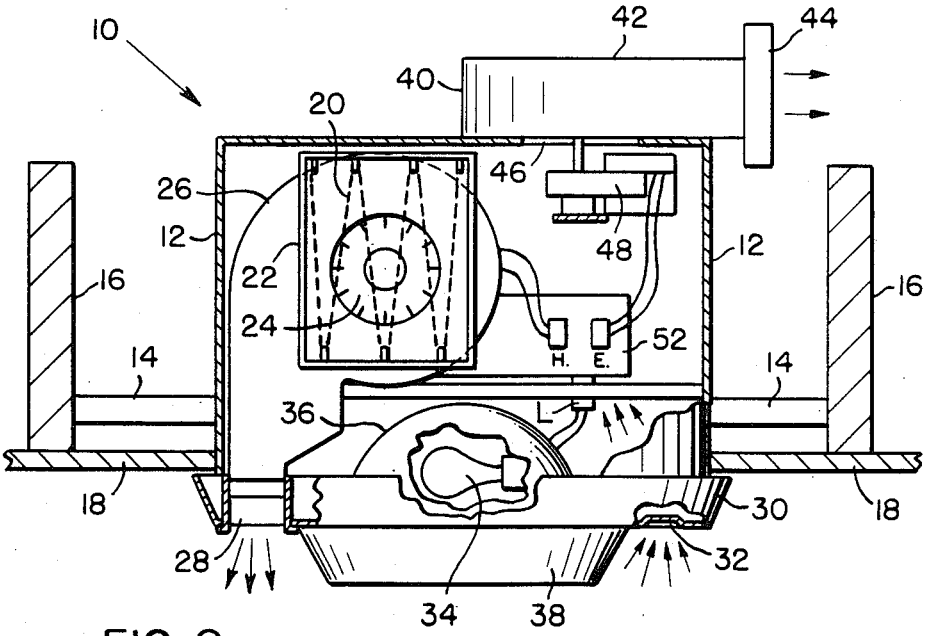
FIG. 2

COMBINATION HEATER-LIGHT-VENTILATOR UNIT

BACKGROUND OF THE INVENTION

This invention relates to an improved heat-light-ventilator unit, and more particularly to a unit of the type which is adapted to be mounted in the ceiling or wall of a bathroom, kitchen or the like for heating, lighting or ventilating of the same.

Combination heater-light-ventilator units are known to the prior art. U.S. Pat. No. 3,320,406 issued May 16, 1967 to Wainwright is one item of such prior art. The most relevant art known to me, which is an improvement on Wainwright, is a heater-light-ventilator unit manufactureed and sold by Fasco industries Inc. as model #657 C. The present invention is an improvement on this prior art.

In Fasco model 657 C, a ceiling-mounted unit has a rectangular face with lights mounted in rectangular portions of the unit at each end, and a heater-ventilator occupying the central portion. A heating element is in the foreground (toward the room) and a fan is mounted behind it, the fan communicating with a duct or exhaust port through which to move air for ventilation of the room. Operation of the heater, lights, and ventilator fan are independent. They can be operated alone, in any combination, or all together.

SUMMARY OF THE INVENTION

The present invention is an improved combination and modification of these elements, directed at more efficient operation, minimal air turbulence, and lower internal operating temperature. This is achieved by a combination heater-light-ventilator unit within a cylindrical housing which also supports a bottom annular grille member. The grille member includes an arcuate heat discharge portion around a portion of the annulus and an air intake portion around the remainder of the annulus. The heat discharge outlet is configured to direct heat flow down and away from the unit to minimize its recirculation through the arcuate air intake. The grille member also supports a light diffuser in its center.

DRAWING

FIG. 1 is a top view of a heater-light-ventilator unit according to this invention.

FIG. 2 is a side elevation view of the same, with the housing broken away and somewhat schematically represented as being mounted between ceiling joints.

DESCRIPTION

Figure 3:
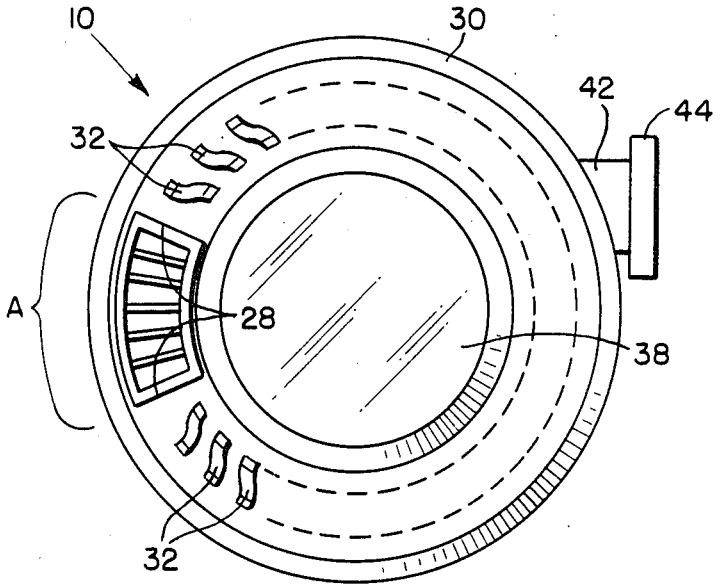
FIG. 3 is a bottom view of the unit, generally as it is seen from below once it is mounted as in FIG. 2.

Referring now to the drawing, numeral 10 designates generally the combination heater-light-ventilator unit of this invention. The unit 10 is mounted in a cylindrical housing 12 which in turn is adapted for connection by suitable mounting bars 14 between ceiling joists 16. The ceiling surface is represented at 18 in FIG. 2. The combined heater-light-ventilator system of this invention is mounted within (or supported by) the housing 12.

An electric heater 20 is disposed in a heater housing 22 adjacent the inlet to a heater fan or blower 24. Heat-blower 24 moves air through a heater-blower housing 26 to a discharge outlet 28 which occupies an arcute portion A of the lower grille 30, mounted to the bottom of the housing 12. Lower grille 30, through the major part of its circumference, is ported as represented at 32 so that there is free communication from below the grille 30 to within the housing 12.

A lamp 34 is mounted within a domed reflector 36 to direct light downward through a diffuser 38. Diffuser 38 is removably mounted to the grille 30 for changing of the lamp and cleaning of the diffuser, as required.

A ventilator fan or blower 40 is mounted atop the housing 12 within a vent-blower housing 42 leading to a discharge outlet 44 which is directed to the exterior. Vent-blower 40 takes air and moisture into its inlet 46 from within the housing 12, which in turn communicates with the room interior through the grille 30. Vent-blower 40 is driven by a motor 48. Heat-blower 24 is similarly driven by a motor 50.

Electrical connections to motors 48 and 50, to heater 20, and to light 34 are shown leading from a junction box 52. Three switches H, E & L are provided, and as shown in FIG. 2 are operatively connected to the motors, heater and lamp for independent operation of the three subsystems, i.e. the heater and heat blower by switch H, the lamp, by switch L, and the vent blower by switch E.

In operation, when heater 20 and heat-blower 24 are on, the warm air discharge at outlet 28 is relatively straight down from the unit as represented by the arrows at outlet 28 in FIG. 2. As viewed from the bottom view of FIG. 3, the warm air is discharged through the arcuate outlet 28. The purpose of this straight-out discharge is to minimize recirculation of this already-heated air, i.e. to avoid drawing it back into the housing through the ports 32 around the rest of the grille. This avoids or minimizes both recirculation of the already-heated air through the heater, and discharge of the heated air through the ventilator, if the ventilator is running simultaneously.

What is claimed is:

1. A combination heater-light-ventilator unit, comprising:

a cylindrical housing having a top member and an upright cylindrical wall supporting said top member, said housing supporting a heating subsystem, a lighting subsystem, and a ventilating subsystem, said heating subsystem including a heater and a heat blower disposed within said housing, said heat blower adapted to discharge downward from said unit through a heat discharge outlet, said lighting subsystem including a light source and a reflector disposed within said housing to direct light downward therefrom, said ventilating subsystem including a vent blower mounted atop said housing, said vent blower communicating on its inlet side with the interior of said housing and adapted to discharge to a remote location through a vent discharge outlet, and an annular grille mounted on the bottom of said cylindrical housing, said annular grille including a first arcuate portion thereof forming said heat discharge outlet of said heating subsystem, and a second arcuate portion thereof having ports permitting free passage of air from below to within said housing, said annular grille further supporting a light diffuser below said lamp.

2. A combination heater-light-ventilator unit, comprising:

a housing supporting a heating subsystem, a lighting subsystem, and a ventilating subsystem, said heating subsystem including a heat blower selectively operable by a first switch, and adapted to discharge warm air downward in a first path from said unit through a heat discharge outlet, said lighting subsystem including a light source and a reflector disposed to direct light downward from said unit, said ventilating subsystem including a vent blower adapted to discharge air from within said housing to a remote location, and selectively operable by a second switch and optionally at the same time as said heat blower, and a grille member mounted on the bottom of said housing, said grille member having a first open portion thereof connected to the outlet of said heat blower and forming said heat discharge outlet of said heating subsystem, and having a second open portion thereof communicating with the inlet to said vent blower along a second path different from said first path, and permitting free passage of air from below to within said housing, said heat discharge outlet configured to direct heat flow away from said unit to minimize recirculation of heated air therethrough.

3. The combination as defined in claim 2, wherein said housing is cylindrical and said open portions of said grille member are arranged in an annular path coaxialy of said housing.

4. The combination as defined in 2, wherein said second open portion of said grille member is greater in size than said first open portion thereof.

5. The combination as defined in claim 4, wherein said open portions of said grille member are arranged in a path surrounding said lighting subsystem.

6. A combination heat-ventilator unit, comprising a housing open at its lower end and supporting at least a heating subsystem and a ventilating subsystem, said heating subsystem including a heat blower selectively operable by a first switch, and adapted to discharge warm air downwardly through a first enclosure in said housing to a heat discharge outlet located in the bottom of said housing, said ventilating subsystem including a vent blower adapted to discharge air from within said housing to a remote location, and selectively operable by a second switch, and optionally at the same time as said heat blower, and a grille member mounted on the bottom of said housing and having therethrough a plurality of openings arrayed in a predetermined path around the marginal edge of said lower, open end of said housing, a minor portion of said openings in said grille member communicating with the outlet of said first enclosure and forming said heat discharge outlet of said heating subsystem, and the remaining openings in said grille member communicating with the interior of said housing externally of said first enclosure, and permitting free passage of air from below to within said housing, whereby upon simultaneous operation of said heat blower and said vent blower warm air travels out of the unit and along a path which is separate from the path along which air enters the housing for discharge to a remote location.

* * * * *